US005240234A

United States Patent [19]

Lee

[11] Patent Number: 5,240,234

[45] Date of Patent: Aug. 31, 1993

[54] CLAMP-ON GUTTER HOLDER

[76] Inventor: Stanley M. Lee, 5907 Nassau St., Forestville, Md. 20247

[21] Appl. No.: 913,204

[22] Filed: Jul. 15, 1992

[51] Int. Cl.[5] ..... B23Q 3/02

[52] U.S. Cl. ..... 269/43; 269/97; 269/274; 269/904; 248/48.2

[58] Field of Search ..... 248/48.2, 539; 81/487, 81/420, 421, 424.5, 426.5; 269/274, 275, 904, 41, 43, 97–98, 3, 6

[56] References Cited

U.S. PATENT DOCUMENTS

| | | | |
|---|---|---|---|
| 2,147,799 | 2/1939 | Reynolds | 248/48.2 |
| 2,339,926 | 1/1944 | Hays | 269/97 |
| 3,154,304 | 10/1964 | Crawford | 33/DIG. 10 |
| 3,837,633 | 9/1974 | Paulsen | 269/97 |
| 4,564,182 | 1/1986 | Svajgl | 269/904 |
| 4,943,039 | 7/1990 | Jackson | 269/97 |

*Primary Examiner*—Robert C. Watson

[57] ABSTRACT

A clamp-on gutter holder, that removably attaches to the fascia board of a dwelling and allows the installer to temporarily position the gutter along the fascia board, align and then nail it at its desired location. Several of the devices are removably attached along the length of the fascia board at spaced intervals, and the gutter is then placed upon the devices for temporary support. After the gutter is securely nailed, the devices are removed for subsequent use by simply releasing the clamping means.

2 Claims, 3 Drawing Sheets

CLAMP-ON GUTTER HOLDER

BACKGROUND OF THE INVENTION

1. Field of the Invention

The present invention relates generally to a device that holds a rain gutter. More specifically, the present invention relates to a clamp-on gutter holder, that when clamped onto the fascia board of a dwelling, will temporarily support a rain gutter allowing the installer to place the gutter in position, align and then fasten the gutter at its desired location.

Present day rain gutters are usually of one-piece construction and their installation to the fascia board has become a difficult task, requiring several persons holding the gutter in position while the fastening spikes are installed.

The roof structure of a typical dwelling has eaves that overhang the exterior walls of the dwelling. The overhanging eaves contain a soffit area on its underside and a fascia board on its front-side. The rain gutter is attached to the fascia board with spikes and extends along the length of the dwelling. The fascia board has a width extending from the lower roof edge to below the horizontal plane of the soffit.

It is the portion of the fascia board that extends below the horizontal plane of the soffit area that will be utilized by the device of the present invention.

Another embodiment of the present invention is designed to attach to the fascia board of a dwelling, that has no overhanging eaves, and the fascia board is installed directly against the exterior wall of the dwelling.

The present invention provides a convenient device that will removably attach to a fascia board and temporarily supports a rain gutter during its installation and can then be removed for subsequent use.

2. Description of Related Art

U.S. Pat. No. 4,564,182 to Svajgl teaches a temporary gutter support apparatus having a vertical inner frame member, with slotted nail holes in which to fasten it to a fascia board, using nails that are partially driven into the fascia board. The apparatus is removed with a upwardly lifting motion to disengage the nails from the slotted holes.

Although, the above mentioned prior art achieves the support of the gutter, it has some major drawbacks, for example, attaching the apparatus to the fascia board may be cumbersome, and detaching it may be difficult and will leave the partially raised nails behind the installed gutter.

Whatever the precise merits, features and advantages of the above cited reference, it does not achieve or fulfill the purpose of the present invention.

SUMMARY OF THE INVENTION

The present invention provides a clamp-on gutter holder, to be used by installers and others, that effectively eases the task of temporarily supporting a rain gutter during its installation.

It is an object of the present invention to provide a device, that is simple to construct, easy to manufacture and efficient to use.

It is also an object of the present invention to provide a device, that is light weight and can be attached to and detached from a fascia board quickly and easily.

Another object of the present invention is to provide a device, that once removably attached to a fascia board allows the installer to be freed from the task of holding the gutter, enabling it to be aligned and nailed at its desired location.

A further object of the present invention is to reduce the amount of time and workmen required to install gutters.

The foregoing objects can be accomplished by the present invention which provides a clamp-on gutter holder, that when removably attached to the fascia board, temporarily holds a rain gutter during its installation and is then easily removed for subsequent use by simply releasing the clamping means.

DETAILED DESCRIPTION

Figure 1:
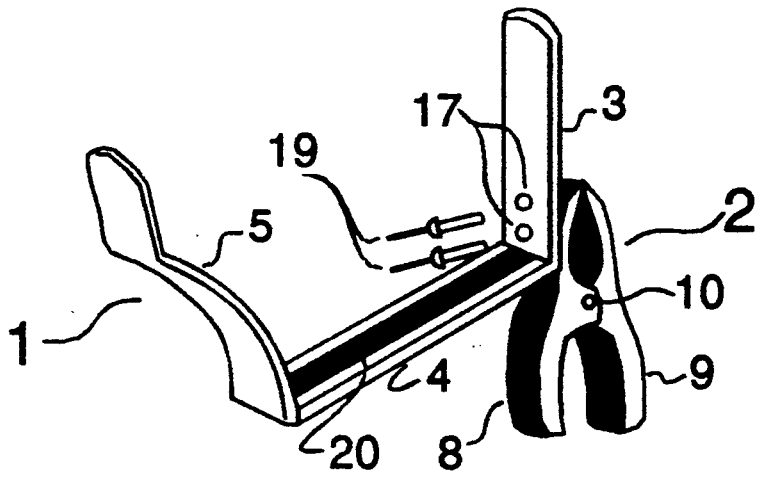
FIG. 1. is a perspective view of the present invention.

For the purpose of promoting an understanding of the purposes of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principals of the invention as illustrated therein being contemplated as would normally occur to one skilled in the art to which the invention relates.

The present invention provides a clamp-on gutter holder, comprising two members, generally referred to as support member 1 and attachment member 2 that are permanently fastened together with a fastening means 19.

Figure 3:
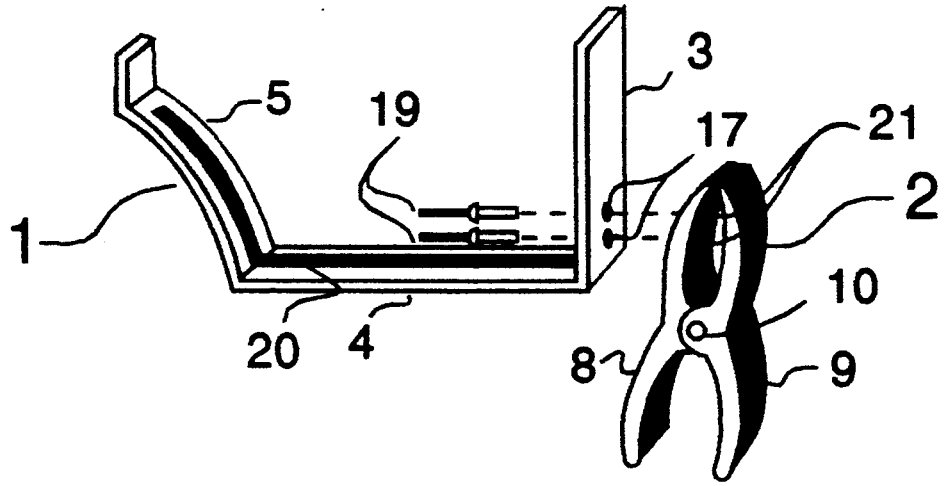
FIG. 3. is an exploded view of the present invention.

The support member 1 of FIG. 3 is of non-pliable material shaped into a particular configuration, comprising integral sections having a vertical back section 3, that extends downwardly aligning parallel with the width of a typical fascia board 18, a horizontal bottom section 4 that extends from vertical back section 3 to a vertical front section 5 that extends upwardly and outwardly from bottom section 4. It has a resilient padding means 20 to protect the gutter 22 from damage, attached to the inside of horizontal bottom section 4 and vertical front section 5 and is dimensioned to be slightly larger than the diameter of the rain gutter 22.

The attachment member 2 as shown in FIG. 3 is a clamping device with fastening holes 21 affixed thereon and having sufficient holding strength to attach to the fascia board 18 of a dwelling. It is comprised of a spring-type clamping means having two one-piece jaw and handle members 8 and 9 that are diametrically opposed and fastened together with a fastening means 10 that allows the members to pivot open and close.

The means for fastening support member 1 to attachment member 2 as shown in FIG. 1 includes rivets 19 however, various other means known in the art may be used.

The present invention is assembled when support member 1 and attachment member 2 are fastened together using a fastening means 19 that is inserted thru the fastening holes 17 of support member 1 and the fastening holes 21 of attachment member 2.

Figure 2:
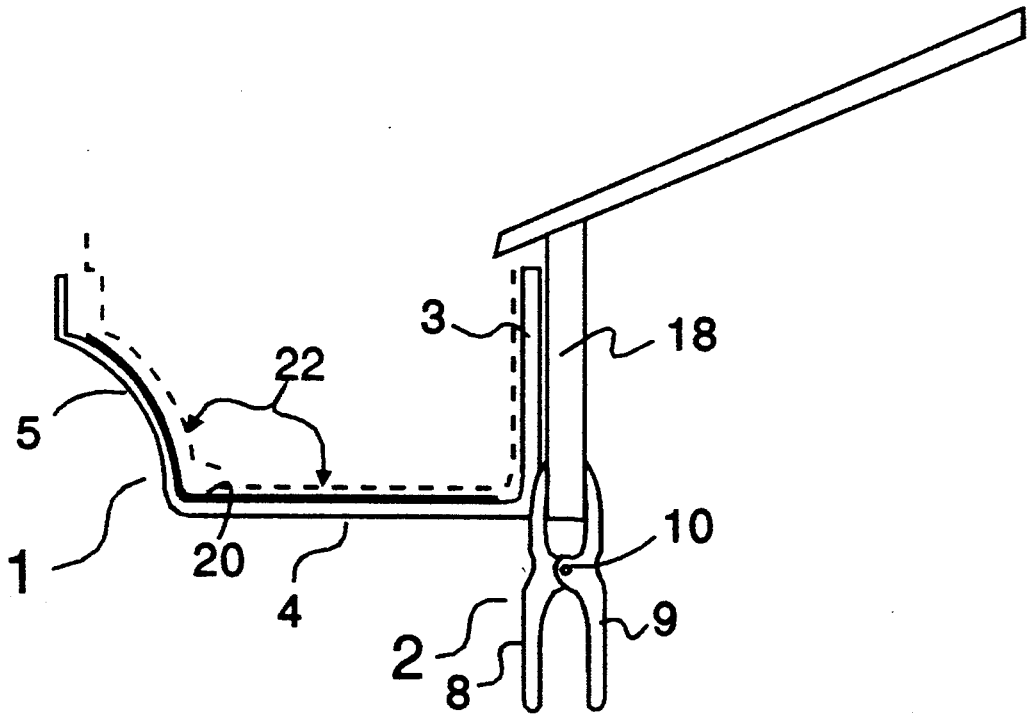
FIG. 2. is a side view of the present invention, removably attached to a fascia board with a rain gutter (shown in broken lines) supported thereon.
Figure 5:
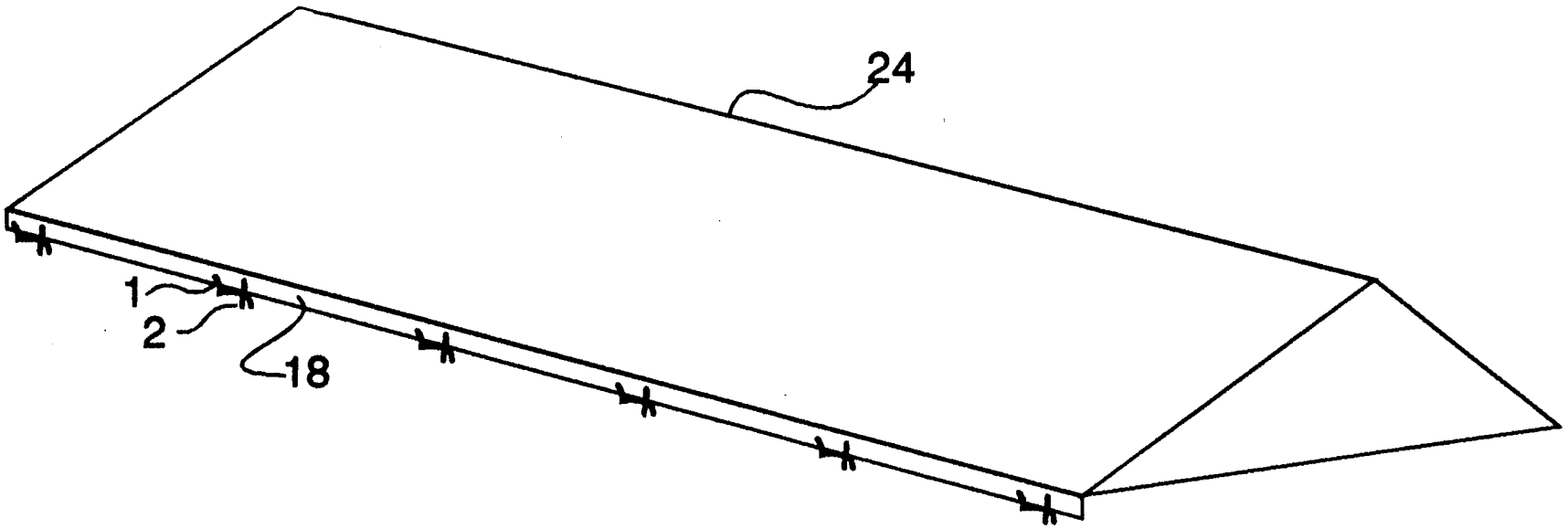
FIG. 5. is a perspective view of a roof structure with several devices of the present invention spaced and removably attached along the length of the fascia board.

The clamp-on gutter holder may now be removably attached to the fascia board of a typical dwelling as illustrated in FIGS. 2 and 5.

Figure 4:
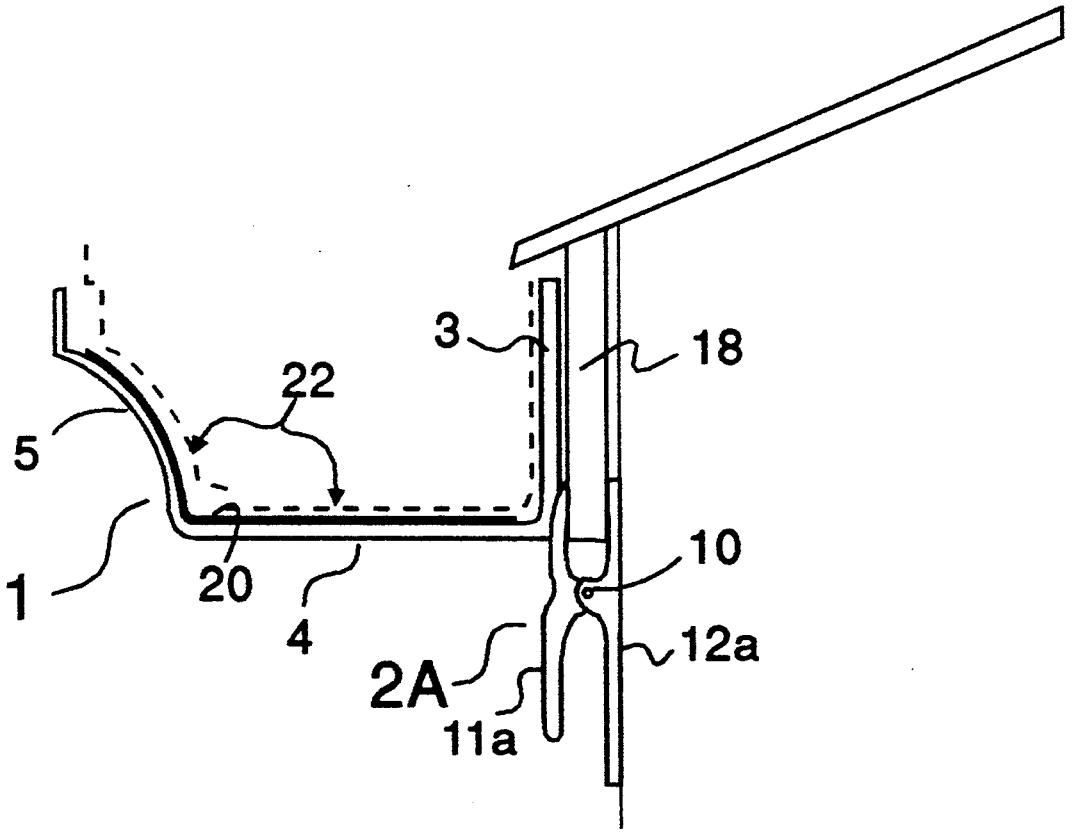
FIG. 4. is another embodiment of the present invention, modified for a dwelling without overhanging eaves.

Another embodiment of the attachment member of the present invention as shown in FIG. 4 and referred to as 2*a* is comprised of a spring-type clamping device having a one piece jaw and handle member 11*a* and a flat vertical member 12*a* that are diametrically opposed and fastened together with a fastening means 10 that allows the members to pivot open and close.

The present invention may be fabricated of other suitable materials such as molded plastic, aluminum, stamped steel or sheet metal and can also be made as an one piece embodiment fabricated in the above mentioned materials.

While the present invention has been illustrated and described in detail in the drawings and foregoing description, the same is to be considered illustrative and not restrictive in character, it being understood that only the preferred embodiment has been shown and described and all changes and modifications that come within the spirit of the invention are desired to be protected.

I claim:

1. A clamp-on gutter holder, that temporarily supports a rain gutter during its installation, comprising:

(a) a support member which further comprises:

a vertical back section, a horizontal bottom section, a vertical front section, a resilient padding means and (b) an attachment member comprising a clamping means having sufficient holding strength to attach to the bottom portion of a fascia board and (c) a means for fastening said support member to said attachment member and (d) said support member is of non-pliable material, shaped into a particular configuration comprising integral sections having said vertical back section, that extends downwardly aligning parallel with the width of a typical fascia board, said horizontal bottom section, that extends from said vertical back section, said vertical front section that extends upwardly and outwardly from said horizontal bottom section, having said resilient padding means attached to the inside of said horizontal bottom section and said vertical front section and is dimensioned to be slightly larger than the diameter of a typical rain gutter and said attachment member is a clamping means having sufficient holding strength to attach to a fascia board, comprising; a spring-type clamping means having two one piece jaw and handle members that are diametrically opposed and fastened by a fastening means that allows said members to pivot open and close, wherein one of the said one-piece jaw and handle members have fastening holes thereon for attaching the clamping means to the vertical back section of the support member.

2. The clamp-on gutter holder of claim 1 wherein the other of the said one-piece jaw and handle members having no fastening holes affixed thereon comprises a flat vertical member.

* * * * *